US006932722B2

(12) United States Patent
Wood

(10) Patent No.: US 6,932,722 B2
(45) Date of Patent: Aug. 23, 2005

(54) CONSISTENT TEE

(76) Inventor: Donald M Wood, 1057 Poplar St., St. Louis, MO (US) 63125

( * ) Notice: Subject to any disclaimer, the term of this patent is extended or adjusted under 35 U.S.C. 154(b) by 0 days.

(21) Appl. No.: 10/120,235

(22) Filed: Apr. 11, 2002

(65) Prior Publication Data

US 2003/0195060 A1 Oct. 16, 2003

(51) Int. Cl.[7] ..... A63B 57/00
(52) U.S. Cl. ..... 473/386; 224/918
(58) Field of Search ..... 473/386, 387–403, 473/283, 284, 407; D21/717, 718; 224/918

(56) References Cited

U.S. PATENT DOCUMENTS 2,211,635 A * 8/1940 Barteaux ..... 473/283
3,289,928 A * 12/1966 Gould ..... 473/283
3,360,170 A * 12/1967 Scannell et al. ..... 224/918
3,658,331 A * 4/1972 Driscoll ..... 473/386
5,152,524 A * 10/1992 Brown ..... 473/284
5,310,177 A * 5/1994 Conrad et al. ..... 473/386
5,385,346 A * 1/1995 Carroll et al. ..... 473/247
5,499,813 A * 3/1996 Black ..... 473/386
5,885,174 A * 3/1999 Barnes ..... 473/386
2002/0183138 A1 * 12/2002 Malcolm ..... 473/386

* cited by examiner

*Primary Examiner*—Steven Wong
(74) *Attorney, Agent, or Firm*—Henry M. Cummings

(57) ABSTRACT

The present invention is a device which is simple in its construction, uses common golf tees, and allows a golfer to carry it easily in his or her pocket. The device comprises a hollow body portion; and and at least one slot to receive a transverse member to accurately and consistently set the position of a golf tee. The body comprises a plurality of vertically spaced slots to receive the transverse member and may include a place for storing tees, and for counting strokes.

3 Claims, 3 Drawing Sheets

CONSISTENT TEE

I FIELD OF THE INVENTION

This invention relates to sports accessories, specifically to a means of setting a golf tee at a consistent, predetermined length above the ground.

II BACKGROUND OF THE INVENTION

To a golfer, an important variable is the height above the ground of the golf tee. Once a golfer determines the proper positioning of a tee, it is vital that he or she be able to position tees at that same height regardless of the condition of the ground or the length of the tee. Various means have been used to achieve this.

For example, U.S. Pat. No. 3,671,037 discloses a golf tee setter-positioner. This device is complex, very massively constructed, and is too large to comfortably carry.

U.S. Pat. No. 5,085,431 discloses a golf tee and placement tool. This device is very complicated and includes a part which functions as a golf tee and may be easily lost.

U.S. Pat. No. 5,735,758 discloses a golf tee insertion gauge. While simple, this device has no provision for storing spare golf tees.

U.S. Pat. No. 5,885,174 discloses an adjustable golf tee setter. This device has no provision for storing spare golf tees.

III SUMMARY OF THE INVENTION

A. Objects of the Invention

One object of the present invention is to provide a means of repeatedly setting golf tees into the ground at a predetermined, consistent height.

Another object of the present invention is to provide a means to set golf tees that is simple in construction and can be easily carried in a golfer's pocket.

Another object of the first embodiment of the present invention is to provide storage for spare tees.

Another object of the second embodiment of the present invention is to provide a convenient means of counting strokes.

Other objects will become evident.

B. Summary

The present invention is a device which is simple in its construction, uses common golf tees, and allows a golfer to carry it easily in his or her pocket. It allows the golfer to easily place a tee into the ground at a height which is optimum for his or her game. The device comprises a hollow body portion; and and at least one slot to receive a transverse member such as a golf tee to accurately and consistently set the position of a golf tee. The body comprises a plurality of vertically spaced slots to receive the transverse member and may include a place for storing tees, and a rotatable cap for counting strokes.

IV. THE DRAWINGS

V. DESCRIPTION OF PREFERRED EMBODIMENTS

Figure 1:
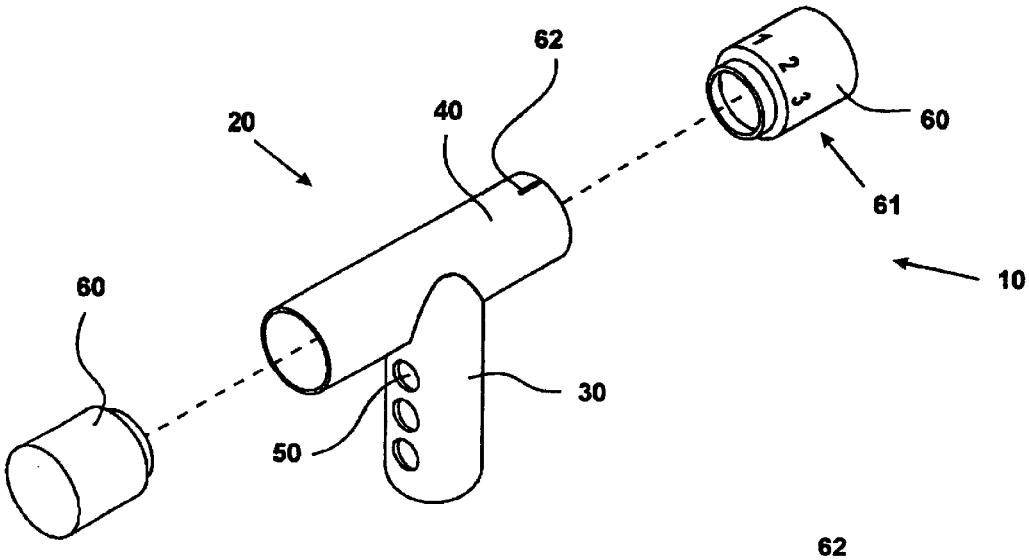
FIGS. 1 and 1A are perspective views of the first embodiment of the present invention.

In accordance with the present invention, the first embodiment of the present invention may be made of metal, heavy plastic, or other economic and easily worked material and is shown generally at 10 (FIG. 1). This embodiment comprises "T" section 20 and end caps 60 with optional stroke counter 61 and 62. "T" section 20 comprises horizontal section 40 and vertical section 30. Vertical section 30 has three or more holes 50 drilled through both sides.

Figure 2:
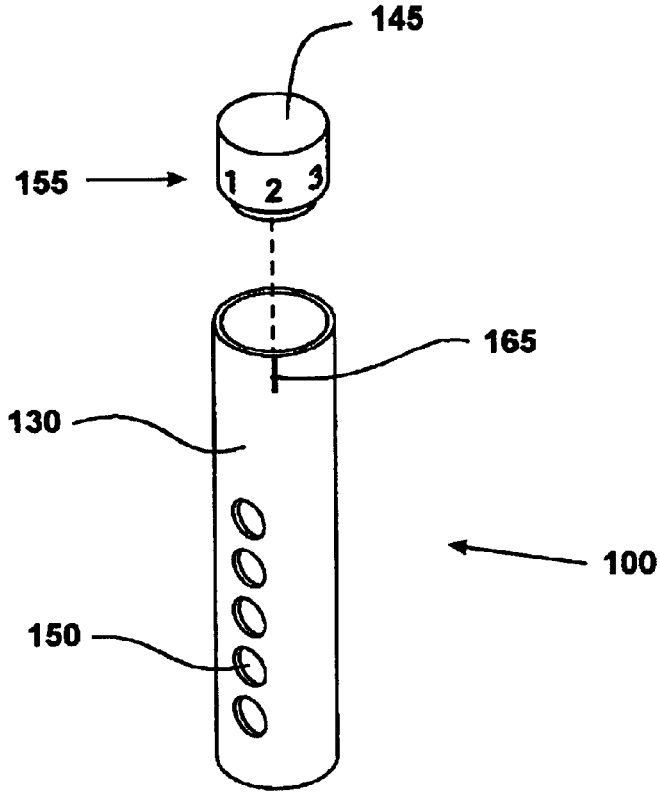
FIGS. 2 and 2A are perspective views of the second embodiment of the present invention.

FIG. 2 shows the second embodiment of the present invention. This embodiment is simpler in construction, comprising top cap 145 and vertical section 130.

Stroke counters 61, 155 comprise a series of numbers inscribed, printed, or otherwise indelibly placed around its outer surface. Vertical section 130 has three or more holes 150 drilled through both sides. Marks 62, 165 are inscribed, printed, or otherwise indelibly placed at the top. To use stroke counters 61, 155, the golfer turns top cap 60, 145 until the desired number is positioned opposite the respective mark 62, 165.

Figure 1A:
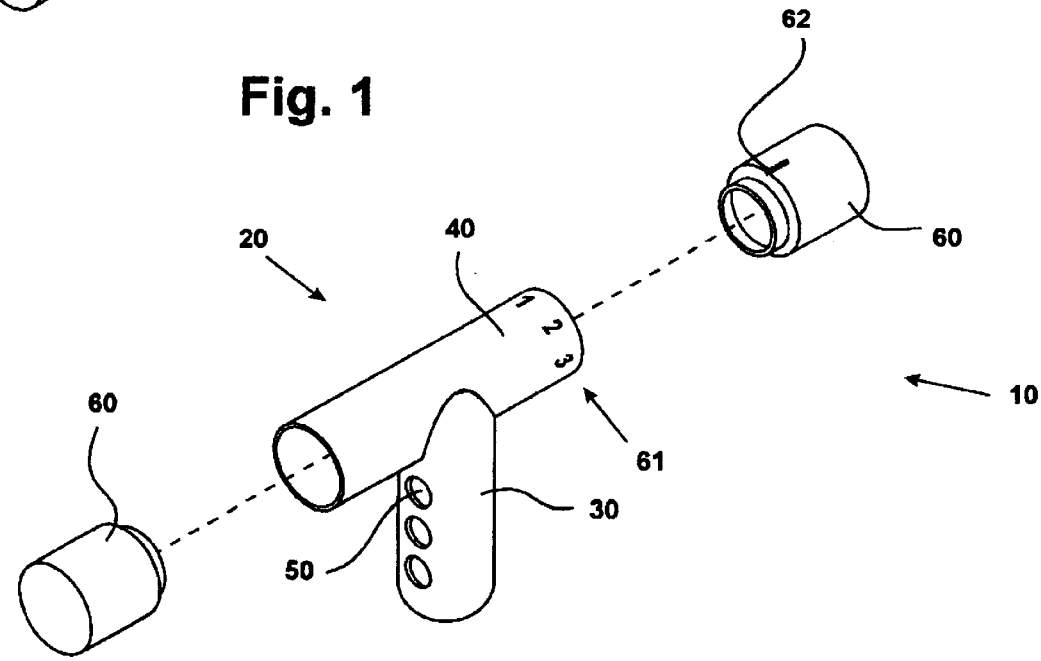
Figure 2A:
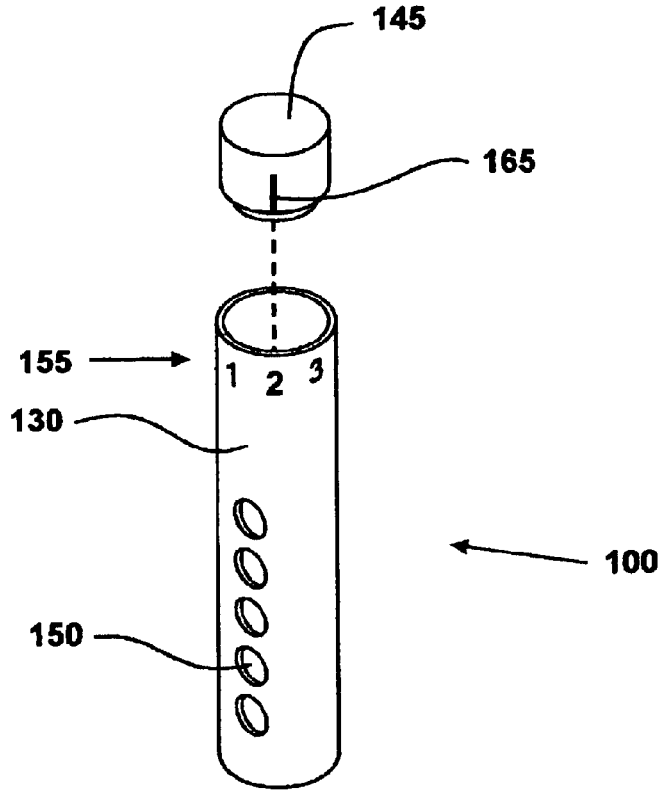

FIGS. 1A and 2A show the numerals 61 and 155 located respectively on the fixed members 40 and 130.

Figure 3:
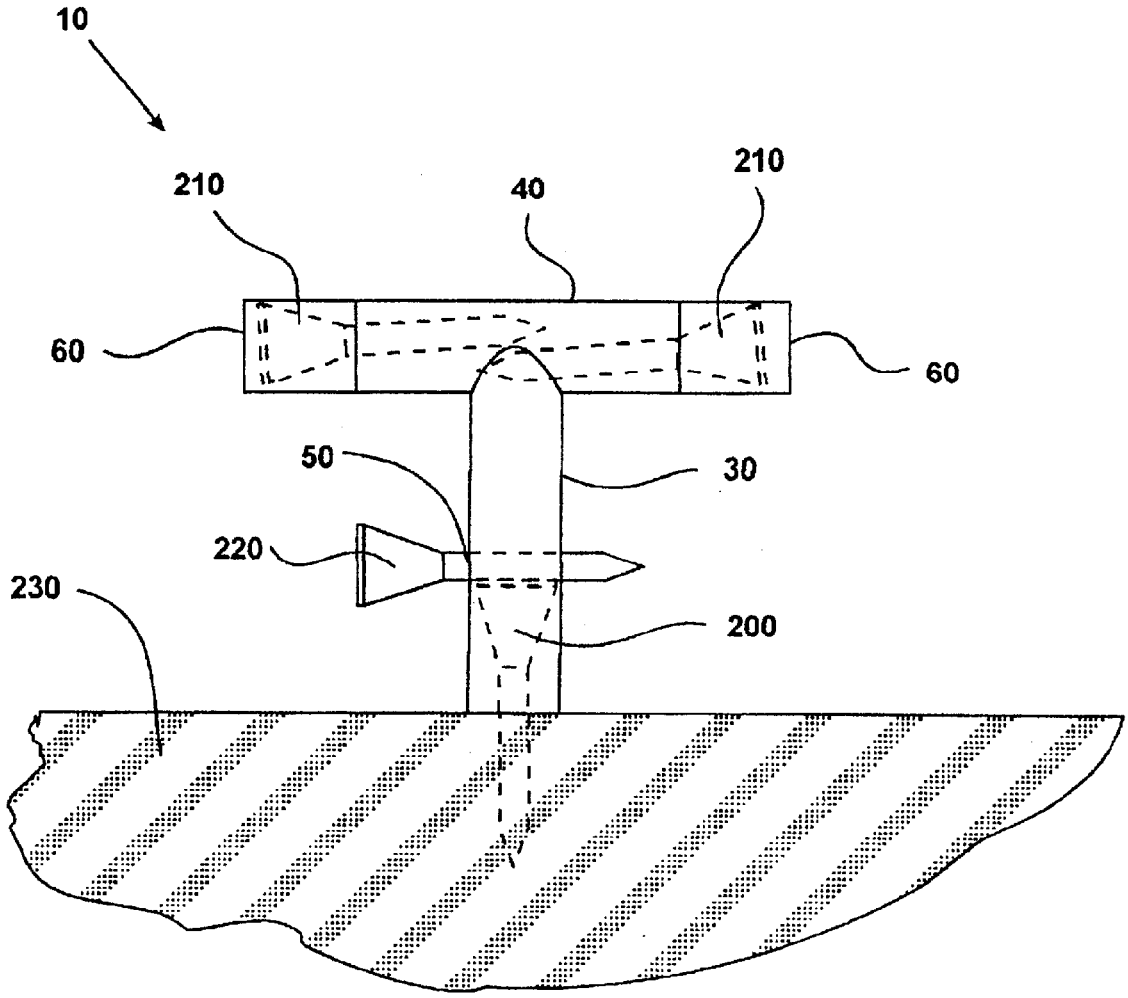
FIG. 3 is a side view of the first embodiment of the present invention in use.

FIG. 3 shows the first embodiment of the present invention in use. The second embodiment is used in an identical manner, with the exception being that the second embodiment lacks space to store spare tees. A golf tee 220 is positioned through vertical section 30 by means of two selected holes 50. Tee 220 now acts as a stop, or gauge for positioning tee 200.

Tee 200 is inserted into the bottom of vertical section 30 until it is stopped by tee 220. Using "T" section 20, the user inserts tee 200 into the ground 230 until the bottom of vertical section 30 is on the surface of ground 230. "T" section 20 is removed from tee 200, which is now positioned as desired.

Note that removing one or both end caps 60 allow storage of spare tees 210.

What is claimed is:

1. A self contained system for housing golf tees and positioning golf tees comprising:

a hollow body portion;

a transverse member to set the position of a golf tee;

said body portion comprising a plurality of vertically spaced slots to receive said transverse member;

said body portion comprising means for storing tees;

said body portion comprising means for counting strokes;

said means for counting strokes comprising a rotatable member mounted on said body and visible numerals and an indicating mark located on one of said rotatable member and said body.

2. A system to position golf tees according to claim 1 wherein said numerals are located on said rotatable member.

3. A system to position golf tees according to claim 1 wherein said numerals are located on said body.

* * * * *